US011472525B2

(12) United States Patent
Sakaue et al.

(10) Patent No.: US 11,472,525 B2
(45) Date of Patent: Oct. 18, 2022

(54) AUTONOMOUS UNDERWATER VEHICLE SUPPORT SYSTEM

(71) Applicant: KAWASAKI JUKOGYO KABUSHIKI KAISHA, Kobe (JP)

(72) Inventors: Hiroshi Sakaue, Kobe (JP); Minehiko Mukaida, Kobe (JP); Kosuke Masuda, Kobe (JP); Shinichi Miyata, Kobe (JP); Manabu Matsui, Nishinomiya (JP); Takashi Okada, Akashi (JP); Takeru Kuzuya, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 50 days.

(21) Appl. No.: 17/048,950

(22) PCT Filed: Apr. 17, 2019

(86) PCT No.: PCT/JP2019/016459

§ 371 (c)(1),
(2) Date: Oct. 19, 2020

(87) PCT Pub. No.: WO2019/203267

PCT Pub. Date: Oct. 24, 2019

(65) Prior Publication Data

US 2021/0147049 A1 May 20, 2021

(30) Foreign Application Priority Data

Apr. 17, 2018 (JP) ..... JP2018-079376

(51) Int. Cl.

| | |
|---|---|
| ***B63G 8/00*** | (2006.01) |
| ***B63G 8/42*** | (2006.01) |
| ***B63C 11/48*** | (2006.01) |

(52) U.S. Cl.
CPC ..... *B63C 11/48* (2013.01); *B63G 8/001* (2013.01); *B63G 8/42* (2013.01); *B63G 2008/004* (2013.01); *B63G 2008/008* (2013.01)

(58) Field of Classification Search
CPC ..... B63C 11/48; B63G 8/001; B63G 8/42; B63G 2008/004; B63G 2008/008; B63G 2008/007; B63B 2021/206
See application file for complete search history.

(56) References Cited

U.S. PATENT DOCUMENTS 9,463,849 B2 * 10/2016 McCabe ..... B63G 8/001
2015/0274260 A1 10/2015 McCabe et al.
(Continued)

FOREIGN PATENT DOCUMENTS

CN 106564573 A * 4/2017
CN 106564573 A 4/2017
(Continued)

*Primary Examiner* — Anthony D Wiest
(74) *Attorney, Agent, or Firm* — Oliff PLC

(57) ABSTRACT

An AUV support system includes: a surface ship; an underwater station configured to support an AUV which autonomously sails in water; and a cable connecting the surface ship and the underwater station. The cable includes: a first cable portion extending downward from the surface ship through a water surface when the underwater station is suspended in the water by the cable from the surface ship that is in a stop state on the water; a second cable portion extending upward from a lower end portion of the first cable portion when the underwater station is suspended as above; and a third cable portion extending downward from an upper end portion of the second cable portion and connected to the underwater station when the underwater station is suspended as above.

2 Claims, 6 Drawing Sheets

AUV DOCKING STATE

(56) References Cited

U.S. PATENT DOCUMENTS

| | | | |
|---|---|---|---|
| 2016/0297502 | A1 | 10/2016 | Heiler et al. |
| 2018/0297677 | A1 | 10/2018 | Sakaue et al. |

FOREIGN PATENT DOCUMENTS

| | | | | | |
|---|---|---|---|---|---|
| CN | 106956760 | A | * | 7/2017 | ..... B63C 11/52 |
| CN | 106956760 | A | | 7/2017 | |
| GB | 1523953 | A | | 9/1978 | |
| JP | 2898050 | B2 | | 5/1999 | |
| JP | 2006-206006 | A | | 8/2006 | |
| JP | 2009-173100 | A | | 8/2009 | |
| JP | 2011-031635 | A | | 2/2011 | |
| JP | 2017-071265 | A | | 4/2017 | |
| WO | 2016/005955 | A1 | | 1/2016 | |

* cited by examiner

MOVING STATE

STOP STATE

AUV DOCKING STATE

STOP STATE

STOP STATE

STOP STATE

AUTONOMOUS UNDERWATER VEHICLE SUPPORT SYSTEM

TECHNICAL FIELD

The present invention relates to an autonomous underwater vehicle support system.

BACKGROUND ART

Conventionally known is an underwater station configured to support an autonomous underwater vehicle (hereinafter may be referred to as an "AUV") which autonomously sails in water.

For example, PTL 1 discloses an AUV support system including a surface ship and an underwater station suspended in water from the surface ship through a cable. According to this system, after the AUV docks with the underwater station suspended in the water from the surface ship through the cable, electric power can be supplied from a power supply portion of the underwater station to a power receiving portion of the AUV.

CITATION LIST Patent Literature

PTL 1: Japanese Laid-Open Patent Application Publication No. 2017-71265

SUMMARY OF INVENTION

Technical Problem

According to the above system, even when the surface ship is in a stop state on the water, the cable connecting the surface ship and the underwater station is stretched tight by the own weight of the underwater station. In this state, when the surface ship is moved by influence of a marine phenomenon or the like, the underwater station is also displaced through the cable. When the movement of the surface ship is transmitted to the underwater station through the cable, the docking of the AUV with the underwater station may be made difficult.

An object of the present invention is to provide an AUV support system capable of suppressing transmission of movement of a surface ship through a cable to an underwater station connected to the surface ship through the cable.

Solution to Problem

In order to solve the above problems, an AUV support system according to the present invention includes: a surface ship; an underwater station configured to support an AUV which autonomously sails in water; and a cable connecting the surface ship and the underwater station. The cable includes a first cable portion extending downward from the surface ship through a water surface when the underwater station is suspended in the water by the cable from the surface ship that is in a stop state on the water, a second cable portion extending upward from a lower end portion of the first cable portion when the underwater station is suspended as above, and a third cable portion extending downward from an upper end portion of the second cable portion and connected to the underwater station when the underwater station is suspend as above.

According to the above configuration, even when the surface ship moves, the lower end portion of the first cable portion and the lower end portion of the second cable portion are displaced, and this can suppress displacement magnitude of the third cable portion. Thus, the transmission of the movement of the surface ship to the underwater station through the cable can be suppressed.

The above AUV support system may further include a sinker located between the first cable portion and the second cable portion.

The above AUV support system may further include a floating body located between the second cable portion and the third cable portion.

The above AUV support system may further include: a sinker located between the first cable portion and the second cable portion; and a floating body located between the second cable portion and the third cable portion. Weights and volumes of the underwater station, the sinker, and the floating body may be adjusted such that Formulas (1) and (2) below are satisfied, $$F \geq W1 \tag{1}$$

$$W2 \geq F - W1 \tag{2}$$

where F denotes a value obtained by subtracting a gravitational force acting on the floating body based on the weight of the floating body from a buoyant force acting on the floating body based on the volume of the floating body in the water, W1 denotes a value obtained by subtracting a buoyant force acting on the underwater station based on the volume of the underwater station in the water from a gravitational force acting on the underwater station based on the weight of the underwater station, and W2 denotes a value obtained by subtracting a buoyant force acting on the sinker based on the volume of the sinker in the water from a gravitational force acting on the sinker based on the weight of the sinker.

In the above AUV support system, the underwater station may be configured to dock with the AUV, and the weights and volumes of the underwater station, the sinker, the floating body, and the AUV may be adjusted such that Formulas (3) to (5) below are satisfied, $$\Delta F < W1 \tag{3}$$

$$F + \Delta F \geq W1 \tag{4}$$

$$W2 \geq F + \Delta F - W1 \tag{5}$$

where F denotes the value obtained by subtracting the gravitational force acting on the floating body based on the weight of the floating body from the buoyant force acting on the floating body based on the volume of the floating body in the water, W1 denotes the value obtained by subtracting the buoyant force acting on the underwater station based on the volume of the underwater station in the water from the gravitational force acting on the underwater station based on the weight of the underwater station, W2 denotes the value obtained by subtracting the buoyant force acting on the sinker based on the volume of the sinker in the water from the gravitational force acting on the sinker based on the weight of the sinker, and ΔF denotes a value obtained by subtracting a gravitational force acting on the AUV based on the weight of the AUV from a buoyant force acting on the AUV based on the volume of the AUV in the water.

The above AUV support system may further include: a sinker located between the first cable portion and the second cable portion; and a floating body located between the second cable portion and the third cable portion. A position of the sinker at the cable may be adjusted such that a depth of the sinker from the water surface when the surface ship is in a stop state on the water is equal to or more than a length of a portion of the cable which portion extends between the floating body and the sinker.

Advantageous Effects of Invention

The present invention can provide the AUV support system capable of suppressing the transmission of the movement of the surface ship through the cable to the underwater station connected to the surface ship by the cable.

DESCRIPTION OF EMBODIMENTS

Hereinafter, embodiments of the present invention will be described with reference to the drawings.

Embodiment 1

Figure 1:
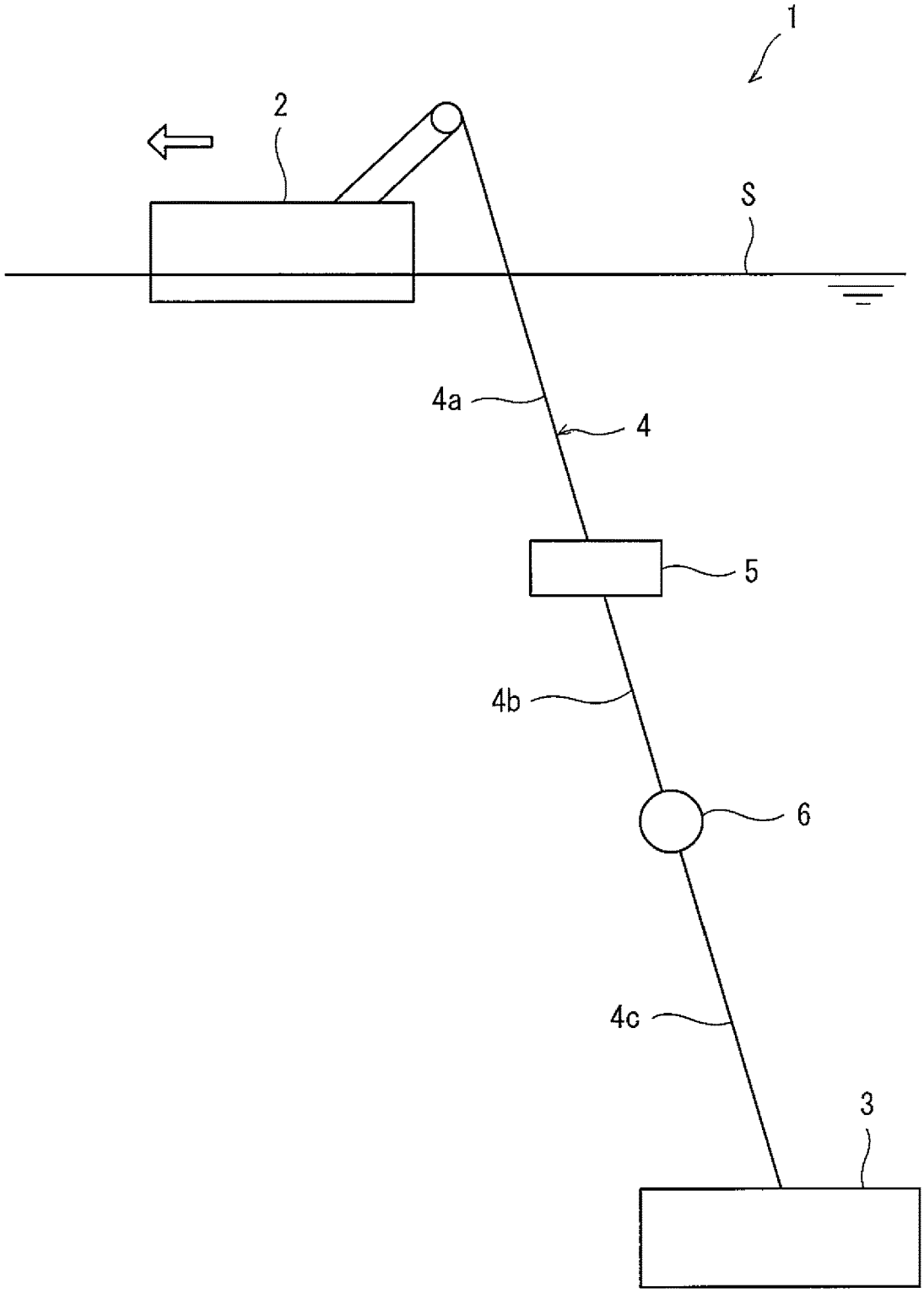
FIG. 1 is a schematic diagram schematically showing an AUV support system according to Embodiment 1 and a diagram showing that a surface ship sails on water.
Figure 2:
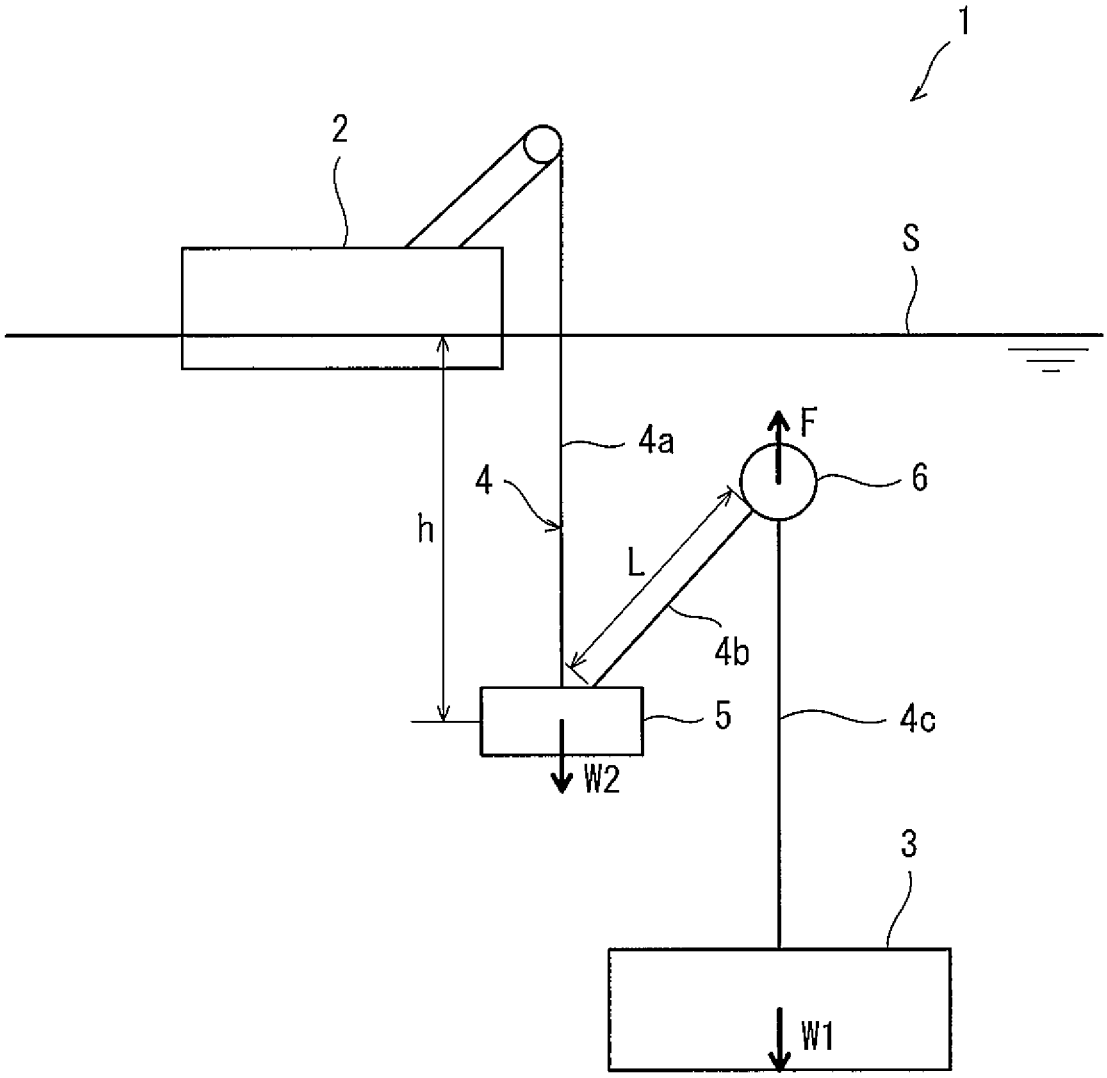
FIG. 2 is a diagram showing that the surface ship is in a stop state on the water in the support system shown in FIG. 1.

FIGS. 1 and 2 are schematic diagrams each schematically showing an AUV support system 1 according to Embodiment 1. The support system 1 includes a surface ship 2 and an underwater station 3 configured to support an AUV 7 (see FIG. 3) which autonomously sails in water. FIG. 1 shows that the surface ship 2 of the support system 1 sails on the water. FIG. 2 shows that the surface ship 2 of the support system 1 is in a stop state on the water. In the description and claims of the present application, the "water" denotes a liquid, such as sea or a lake, in which the AUV can sail, and for example, "in the water" denotes "in the sea, "in the lake," or the like.

The surface ship 2 and the underwater station 3 are connected to each other through a cable 4. As shown in FIG. 1, when the surface ship 2 sails on the water, the underwater station 3 is pulled and towed by the cable 4. In this case, the cable 4 extends substantially linearly from the surface ship 2 to the underwater station 3. The cable 4 includes, for example, a power transmission line through which electricity is transmitted from the surface ship 2 to the underwater station 3 and/or a communication line for communication with the surface ship 2. To be specific, when the AUV docks with the underwater station 3 of the present embodiment, a built-in battery of the AUV can be charged in the water, and/or data acquired by the AUV in the water can be transmitted to the surface ship 2 through the cable 4.

A sinker 5 and a floating body 6 are attached to the cable 4. The sinker 5 and the floating body 6 are provided at the cable 4 in this order from a side close to the surface ship 2 along the cable 4. To be specific, the sinker 5 is provided at the cable 4 so as to be located between the floating body 6 and the surface ship 2. In the present embodiment, the positions of the sinker 5 and the floating body 6 relative to the cable 4 are fixed. It should be noted that one or both of the sinker 5 and the floating body 6 may be attached to the cable 4 so as to be movable within a predetermined range along the cable 4.

Next, a positional relation among the underwater station 3, the sinker 5, and the floating body 6 in the water when the surface ship 2 of the support system 1 is in a stop state on the water will be described with reference to FIG. 2. In the following description, a portion of the cable 4 which portion extends between the surface ship 2 and the sinker 5 is referred to as a "first cable portion 4*a*." Moreover, a portion of the cable 4 which portion extends between the sinker 5 and the floating body 6 is referred to as a "second cable portion 4*b*." Furthermore, a portion of the cable 4 which portion extends between the floating body 6 and the underwater station 3 is referred to as a "third cable portion 4*c*." To be specific, the sinker 5 is located between the first cable portion 4*a* and the second cable portion 4*b*, and the floating body 6 is located between the second cable portion 4*b* and the third cable portion 4*c*.

In the water, a gravitational force acting on the underwater station 3 is larger than a buoyant force acting on the underwater station 3. Therefore, as shown in FIG. 2, a force W1 that is a resultant force of the gravitational force and buoyant force of the underwater station 3 acts on the underwater station 3 in the water in a vertically downward direction. To be specific, the force W1 has a value obtained by subtracting the buoyant force acting on the underwater station 3 from the gravitational force acting on the underwater station 3.

Moreover, in the water, the gravitational force acting on the sinker 5 is larger than the buoyant force acting on the sinker 5. Therefore, as shown in FIG. 2, a force W2 that is a resultant force of the gravitational force and buoyant force of the sinker 5 acts on the sinker 5 in the water in the vertically downward direction. To be specific, the force W2 has a value obtained by subtracting the buoyant force acting on the sinker 5 from the gravitational force acting on the sinker 5.

Furthermore, in the water, the gravitational force acting on the floating body 6 is smaller than the buoyant force acting on the floating body 6. Therefore, as shown in FIG. 2, a force F that is a resultant force of the gravitational force and buoyant force of the floating body 6 acts on the floating body 6 in the water in a vertically upward direction. To be specific, the force F has a value obtained by subtracting the gravitational force acting on the floating body 6 from the buoyant force acting on the floating body 6.

It should be noted that the buoyant forces acting on the underwater station 3, the sinker 5, and the floating body 6 in the water have respective values that are based on the volumes of the underwater station 3, the sinker 5, and the floating body 6. Moreover, the gravitational forces acting on the underwater station 3, the sinker 5, and the floating body 6 have respective values that are based on the weights of the underwater station 3, the sinker 5, and the floating body 6.

As above, by the forces acting on the underwater station 3, the sinker 5, and the floating body 6 in the water, the cable 4 when the surface ship 2 is in a stop state on the water has such a shape as to extend downward from the surface ship 2, extend upward once, and extend downward again.

Specifically, when the underwater station 3 is suspended in the water by the cable 4 from the surface ship 2 that is in a stop state on the water, the first cable portion 4*a* extends downward from the surface ship 2 through a water surface S toward the sinker 5 located in the water. It should be noted that a length of the first cable portion 4*a* is such an adequate length that the sinker 5 located in the water is arranged at a position downwardly and adequately away from the water surface S. The second cable portion 4*b* extends upward from the sinker 5 (in other words, from a lower end portion of the first cable portion 4*a*) toward the floating body 6. The third cable portion 4*c* extends downward from the floating body 6 (in other words, from an upper end portion of the second cable portion 4*b*) toward the underwater station 3.

When the surface ship 2 is in a stop state on the water, the floating body 6 suspends the underwater station 3 by the third cable portion 4*c*. More specifically, the force F acting on the floating body 6 and the force W1 acting on the underwater station 3 satisfy a relation represented by Formula (1) below.

$$F \geq W1 \quad (1)$$

It should be noted that in the present embodiment, the gravitational force and buoyant force of the cable 4 are negligibly small compared to the gravitational forces and buoyant forces of the underwater station 3, the sinker 5, and the floating body 6.

Moreover, in the present embodiment, the floating body 6 is configured to be located in the water. More specifically, a tensile force by which the second cable portion 4*b* and the third cable portion 4*c* pull the floating body 6 downward is set to be equal to or larger than the force F acting on the floating body 6. In the support system 1, since a depth of the underwater station 3 when the surface ship 2 is in a stop state on the water is adjusted so as to be maintained at a fixed depth, a tensile force of the third cable portion 4*c* is the force W1. For example, when the first cable portion 4*a* loosens, and the floating body 6 suspends the sinker 5 by the second cable portion 4*b*, the tensile force of the second cable portion 4*b* is the force W2.

Therefore, a condition which does not allow the floating body 6 to float on the water by the force F is represented by a formula "F≤W1+W2." By rewriting this formula as a condition of the force W2 which does not allow the floating body 6 to float on the water by the force F, Formula (2) below is obtained.

$$W2 \geq F - W1 \quad (2)$$

As above, the weights and volumes of the underwater station 3, the sinker 5, and the floating body 6 are adjusted such that Formulas (1) and (2) above are satisfied. This realizes a state where the underwater station 3 is suspended by the third cable portion 4*c* that is stretched tight, and the floating body 6 is located in the water.

However, in a case where a depth h of the sinker 5 from the water surface S when the surface ship 2 is in a stop state on the water is equal to or less than a length L of the second cable portion 4*b*, the floating body 6 may float on the water. Therefore, in the present embodiment, in order that the floating body 6 is surely located in the water, the depth h of the sinker 5 from the water surface S when the surface ship 2 is in a stop state on the water is adjusted so as to be equal to or more than the length L of the second cable portion 4*b*.

As described above, in the AUV support system 1 according to the present embodiment, the cable 4 extends downward from the surface ship 2 toward the sinker 5, extends upward from the sinker 5 toward the floating body 6, and then extends downward from the floating body 6 toward the underwater station 3. Therefore, even when the surface ship 2 moves, the sinker 5 between the surface ship 2 and the floating body 6 at the cable 4 is displaced, and this can suppress displacement magnitude of the floating body 6. With this, the transmission of the movement of the surface ship 2 to the underwater station 3 through the cable 4 can be suppressed.

AUV Docking

Figure 3:
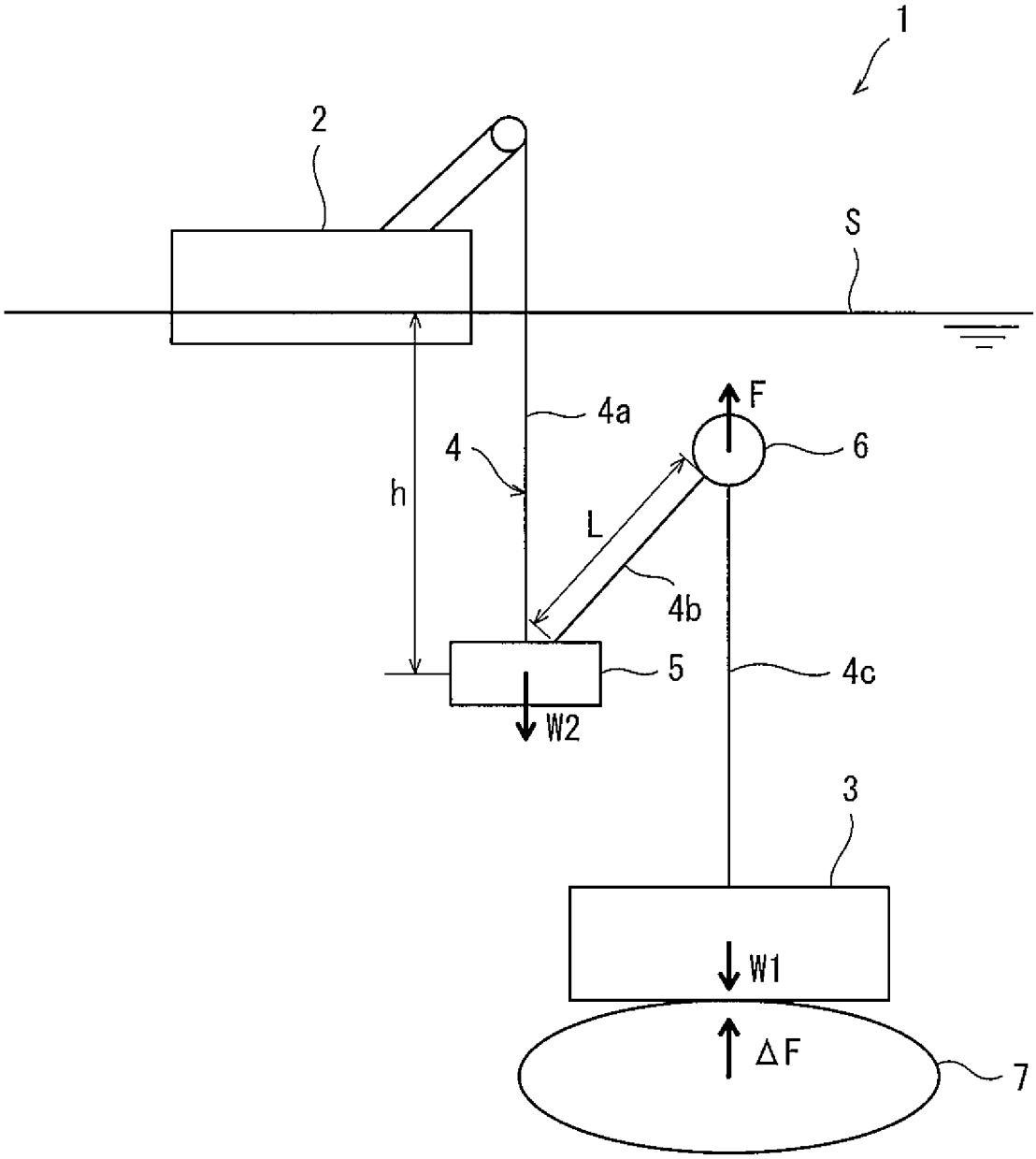
FIG. 3 is a diagram showing that an AUV has docked with an underwater station in the support system shown in FIG. 1.

FIG. 3 is a diagram showing that the AUV 7 has docked with the underwater station 3 in the support system 1. In the present embodiment, even when the AUV 7 has docked with the underwater station 3, the cable 4 extends downward from the surface ship 2 toward the sinker 5, extends upward from the sinker 5 toward the floating body 6, and then extends downward from the floating body 6 toward the underwater station 3.

In the water, the gravitational force acting on the AUV 7 is smaller than the buoyant force acting on the AUV 7. Therefore, as shown in FIG. 3, a force ΔF that is a resultant force of the gravitational force and buoyant force of the AUV 7 acts on the AUV 7 in the water in the vertically upward direction. To be specific, the force ΔF has a value obtained by subtracting the gravitational force acting on the AUV 7 from the buoyant force acting on the AUV 7.

In order that the underwater station 3 with which the AUV 7 has docked does not float on the water, the force ΔF acting on the AUV 7 and the force W1 acting on the underwater station 3 satisfy a relation represented by Formula (3) below.

$$\Delta F < W1 \quad (3)$$

Moreover, the floating body 6 suspends the underwater station 3, with which the AUV 7 has docked, by the third cable portion 4*c*. More specifically, the force F acting on the floating body 6, the force W1 acting on the underwater station 3, and the force ΔF acting on the AUV 7 satisfy a relation represented by Formula (4) below.

$$F + \Delta F \geq W1 \quad (4)$$

Furthermore, the floating body 6 is configured to be located in the water. More specifically, the tensile force by which the second cable portion 4*b* and the third cable portion 4*c* pull the floating body 6 downward is set to be equal to or larger than the force F acting on the floating body 6. In the support system 1, the tensile force of the third cable portion 4*c* has a value obtained by subtracting the force ΔF acting on the AUV 7 in the vertically upward direction from the force W1 acting on the underwater station 3 in the vertically downward direction. For example, when the first cable portion 4*a* loosens, and the floating body 6 suspends the sinker 5 by the second cable portion 4*b*, the tensile force of the second cable portion 4*b* is the force W2.

Therefore, the condition which does not allow the floating body 6 to float on the water by the force F is represented by a formula "F≤(W1−ΔF)+W2." By rewriting this formula as the condition of the force W2 which does not allow the floating body 6 to float on the water by the force F, Formula (5) below is obtained.

$$W2 \geq F + \Delta F - W1 \quad (5)$$

As above, the weights and volumes of the underwater station 3, the sinker 5, the floating body 6, and the AUV 7 are adjusted such that Formulas (3) to (5) are satisfied. This realizes a state where even when the AUV 7 has docked with the underwater station 3, the underwater station 3 is suspended by the third cable portion 4*c* that is stretched tight, and the floating body 6 is located in the water.

Embodiment 2

Figure 4:
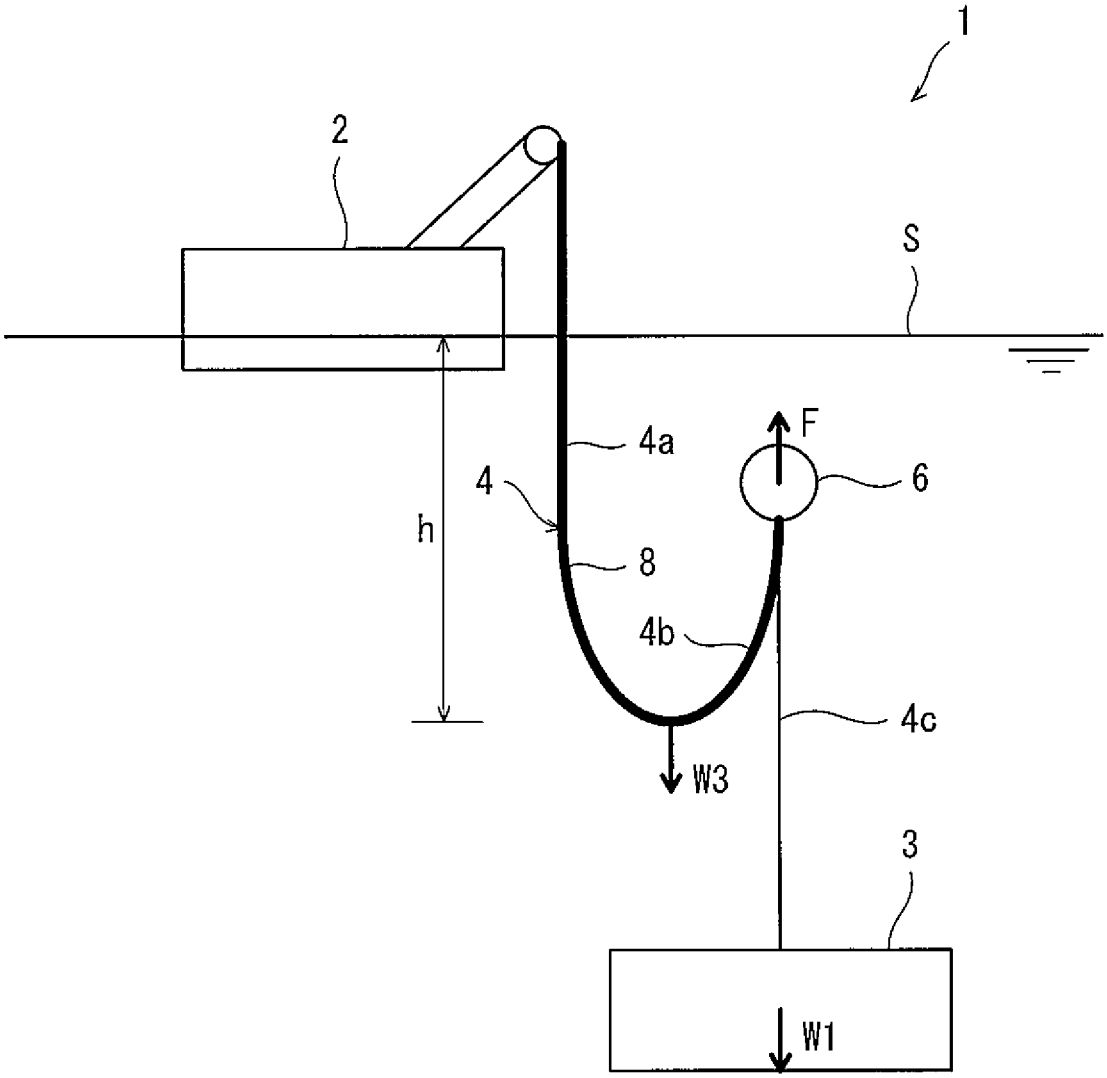
FIG. 4 is a schematic diagram schematically showing the AUV support system according to Embodiment 2.

Next, Embodiment 2 of the present invention will be described with reference to FIG. 4. FIG. 4 is a schematic diagram schematically showing the AUV support system according to Embodiment 2. As with FIG. 2, FIG. 4 shows that the surface ship 2 is in a stop state on the water.

In Embodiment 2 and Embodiments 3 and 4 described below, the repetition of the same explanation is suitably avoided. Moreover, in Embodiments 2 to 4, the "first cable portion 4*a*" is a portion of the cable 4 which portion extends downward from the surface ship 2 through the water surface S when the underwater station 3 is suspended in the water by the cable 4 from the surface ship 2 that is in a stop state on the water. Moreover, the "second cable portion 4*b*" is a portion of the cable 4 which portion extends upward from the lower end portion of the first cable portion 4*a* when the underwater station 3 is suspended in the water by the cable 4 from the surface ship 2 that is in a stop state on the water. Furthermore, the "third cable portion 4*c*" is a portion of the cable 4 which portion extends downward from the upper end portion of the second cable portion 4*b* and is connected to the underwater station 3 when the underwater station 3 is suspended in the water by the cable 4 from the surface ship 2 that is in a stop state on the water.

In the present embodiment, the floating body 6 is provided at the cable 4, but the sinker 5 is not provided at the cable 4. To be specific, the sinker 5 is not provided between the first cable portion 4*a* and the second cable portion 4*b*. Instead, the weight of a portion (i.e., the first cable portion 4*a* and the second cable portion 4*b*) of the cable 4 which portion is located between the floating body 6 and the surface ship 2 is non-negligibly large compared to the gravitational forces and buoyant forces of the underwater station 3, the sinker 5, and the floating body 6. Hereinafter, the portion of the cable 4 which portion extends between the floating body 6 and the surface ship 2 is referred to as a "negative buoyant force cable portion 8." For example, the negative buoyant force cable portion 8 is realized by: being formed by a material having specific gravity relatively larger than specific gravity (for example, 1) of the water (such as water, sea water, or lake water) around the cable 4; being formed such that a filled layer filled with a material having larger specific gravity than the water around the cable 4 is provided around a cable main body constituted by a transmission line, an insulating layer therearound, and the like; being formed such that a cable main body is integrated with a tube filled with a material having large specific gravity; or attaching weight members to an outside of a cable main body at regular intervals.

When the underwater station 3 is suspended in the water by the cable 4 from the surface ship 2 that is in a stop state on the water, the gravitational force acting on the negative buoyant force cable portion 8 is larger than the buoyant force acting on the negative buoyant force cable portion 8. Therefore, as shown in FIG. 4, a force W3 that is a resultant force of the gravitational force and buoyant force of the negative buoyant force cable portion 8 acts on the negative buoyant force cable portion 8 in the vertically downward direction. To be specific, the force W3 has a value obtained by subtracting the buoyant force acting on the negative buoyant force cable portion 8 from the gravitational force acting on the negative buoyant force cable portion 8. The force W3 acting on the negative buoyant force cable portion 8 is represented by Formula (6) below.

$$W3 = wa \times la - fa \times lb \quad (6)$$

In Formula (6), wa denotes a gravitational force per unit length of the negative buoyant force cable portion 8, la denotes an entire length of the negative buoyant force cable portion 8, fa denotes a buoyant force per unit length of the negative buoyant force cable portion 8, and lb denotes a length of an immersed portion (in other words, a portion located lower than the water surface S) of the negative buoyant force cable portion 8.

Moreover, in the present embodiment, the gravitational force wa per unit length of the negative buoyant force cable portion 8 and the buoyant force fa per unit length of the negative buoyant force cable portion 8 (i.e., the weight and volume per unit length which influence the gravitational force wa and the buoyant force fa) are adjusted such that the force W3 satisfies Formula (7) below.

$$W3 \geq F - W1 \quad (7)$$

As above, as shown in FIG. 4, the negative buoyant force cable portion 8 includes: the first cable portion 4*a* extending downward from the surface ship 2 through the water surface S when the underwater station 3 is suspended in the water by the cable 4 from the surface ship 2 that is in a stop state on the water; and the second cable portion 4*b* extending upward from the lower end portion of the first cable portion 4*a* when the underwater station 3 is suspended as above. It should be noted that the gravitational force wa per unit length of the negative buoyant force cable portion 8 is adjusted such that a length of the second cable portion 4*b* is adequately secured (for example, several meters).

According to the present embodiment, even when the surface ship 2 moves, the lower end portion of the first cable portion 4*a* and the lower end portion of the second cable portion 4*b* are displaced, and this can suppress the displacement magnitude of the third cable portion 4*c*. Thus, the transmission of the movement of the surface ship 2 to the underwater station 3 through the cable 4 can be suppressed.

Embodiment 3

Figure 5:
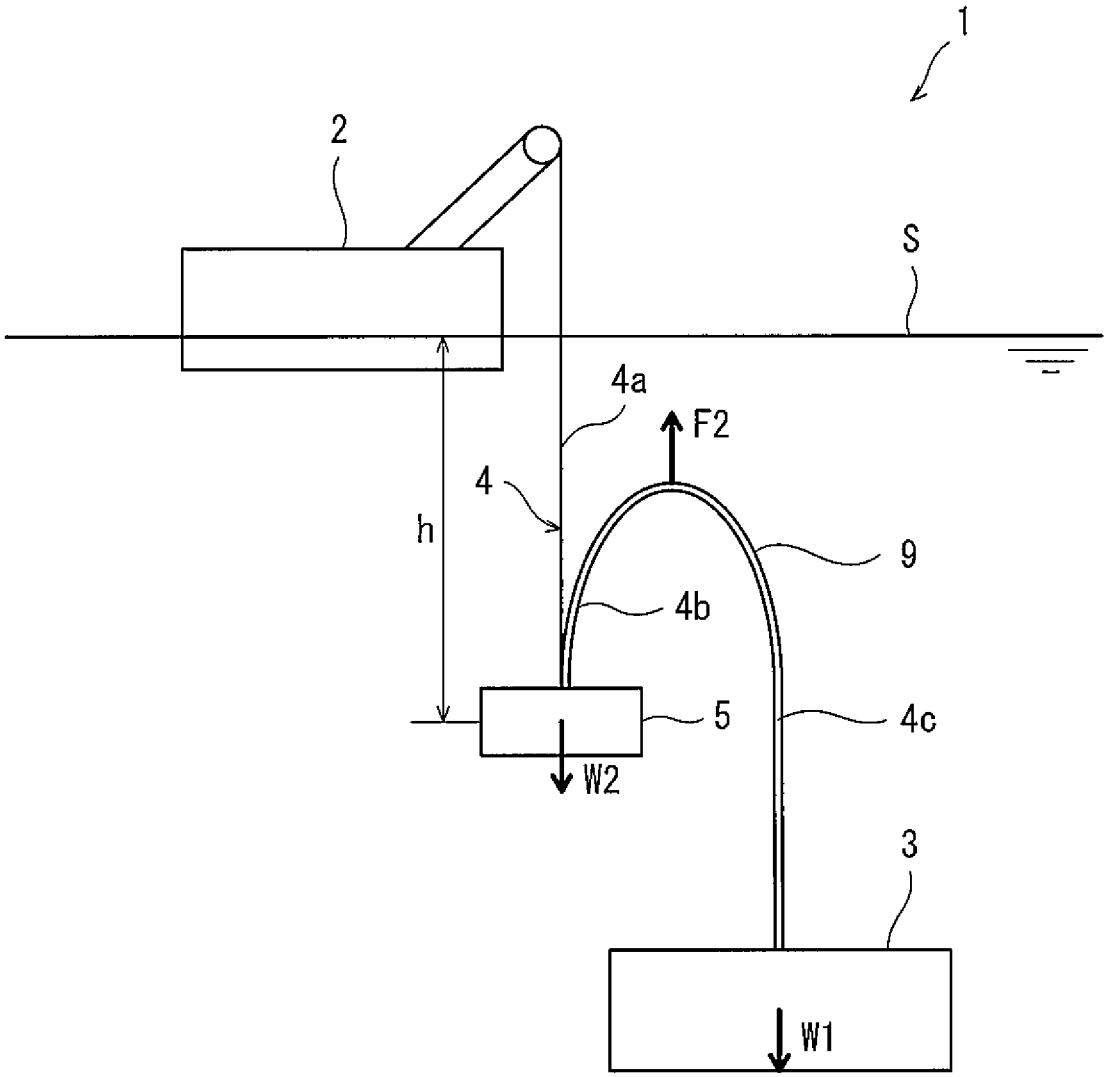
FIG. 5 is a schematic diagram schematically showing the AUV support system according to Embodiment 3.

Next, Embodiment 3 of the present invention will be described with reference to FIG. 5. FIG. 5 is a schematic diagram schematically showing the AUV support system according to Embodiment 3. As with FIGS. 2 and 4, FIG. 5 shows that the surface ship 2 is in a stop state on the water.

In the present embodiment, the sinker 5 is provided at the cable 4, but the floating body 6 is not provided at the cable 4. To be specific, the floating body 6 is not provided between the second cable portion 4*b* and the third cable portion 4*c*. Instead, the buoyant force acting on a portion of the cable 4 which portion extends between the sinker 5 and the underwater station 3 is non-negligibly large compared to the gravitational forces and buoyant forces of the underwater station 3, the sinker 5, and the floating body 6. Hereinafter, the portion of the cable 4 which portion extends between the floating body 6 and the underwater station 3 is referred to as a "positive buoyant force cable portion 9." For example, the positive buoyant force cable portion 9 is realized by: being formed by a material having specific gravity relatively smaller than specific gravity (for example, 1) of the water (such as water, sea water, or lake water) around the cable 4; being formed such that an air layer filled with gas, such as air, is provided around a cable main body constituted by a transmission line, an insulating layer therearound, and the like; being formed such that a cable main body is integrated with an air tube filled with gas, such as air; or attaching buoyant members to an outside of a cable main body at regular intervals.

When the underwater station 3 is suspended in the water by the cable 4 from the surface ship 2 that is in a stop state on the water, the gravitational force acting on the positive buoyant force cable portion 9 is smaller than the buoyant force acting on the positive buoyant force cable portion 9. Therefore, as shown in FIG. 5, a force F2 that is a resultant force of the gravitational force and buoyant force of the positive buoyant force cable portion 9 acts on the positive buoyant force cable portion 9 in the vertically upward direction. To be specific, the force F2 has a value obtained by subtracting the gravitational force acting on the positive buoyant force cable portion 9 from the buoyant force acting on the positive buoyant force cable portion 9. The force F2 acting on the positive buoyant force cable portion 9 is represented by Formula (8) below.

$$F2=fb\times lc-wb\times lc=(fb-wb)\times lc \quad (8)$$

In Formula (8), fb denotes a buoyant force per unit length of the positive buoyant force cable portion 9, wb denotes a gravitational force per unit length of the positive buoyant force cable portion 9, and lc denotes an entire length of the positive buoyant force cable portion 9.

Moreover, in the present embodiment, the gravitational force wb per unit length of the positive buoyant force cable portion 9 and the buoyant force fb per unit length of the positive buoyant force cable portion 9 (i.e., the weight and volume per unit length which influence the gravitational force wb and the buoyant force fb) are adjusted such that the force F2 satisfies Formulas (9) and (10) below.

$$F2\geq W1 \quad (9)$$

$$W2\geq F2-W1 \quad (10)$$

As above, as shown in FIG. 5, the positive buoyant force cable portion 9 includes: the second cable portion 4*b* extending upward from the sinker 5, located at the lower end portion of the first cable portion 4*a*, when the underwater station 3 is suspended in the water by the cable 4 from the surface ship 2 that is in a stop state on the water; and the third cable portion 4*c* extending downward from the upper end portion of the second cable portion 4*b* and connected to the underwater station 3 when the underwater station 3 is suspended as above.

According to the present embodiment, even when the surface ship 2 moves, the sinker 5 located at the lower end portion of the first cable portion 4*a* and the lower end portion of the second cable portion 4*b* is displaced, and this can suppress the displacement magnitude of the third cable portion 4*c*. Thus, the transmission of the movement of the surface ship 2 to the underwater station 3 through the cable 4 can be suppressed.

Embodiment 4

Figure 6:
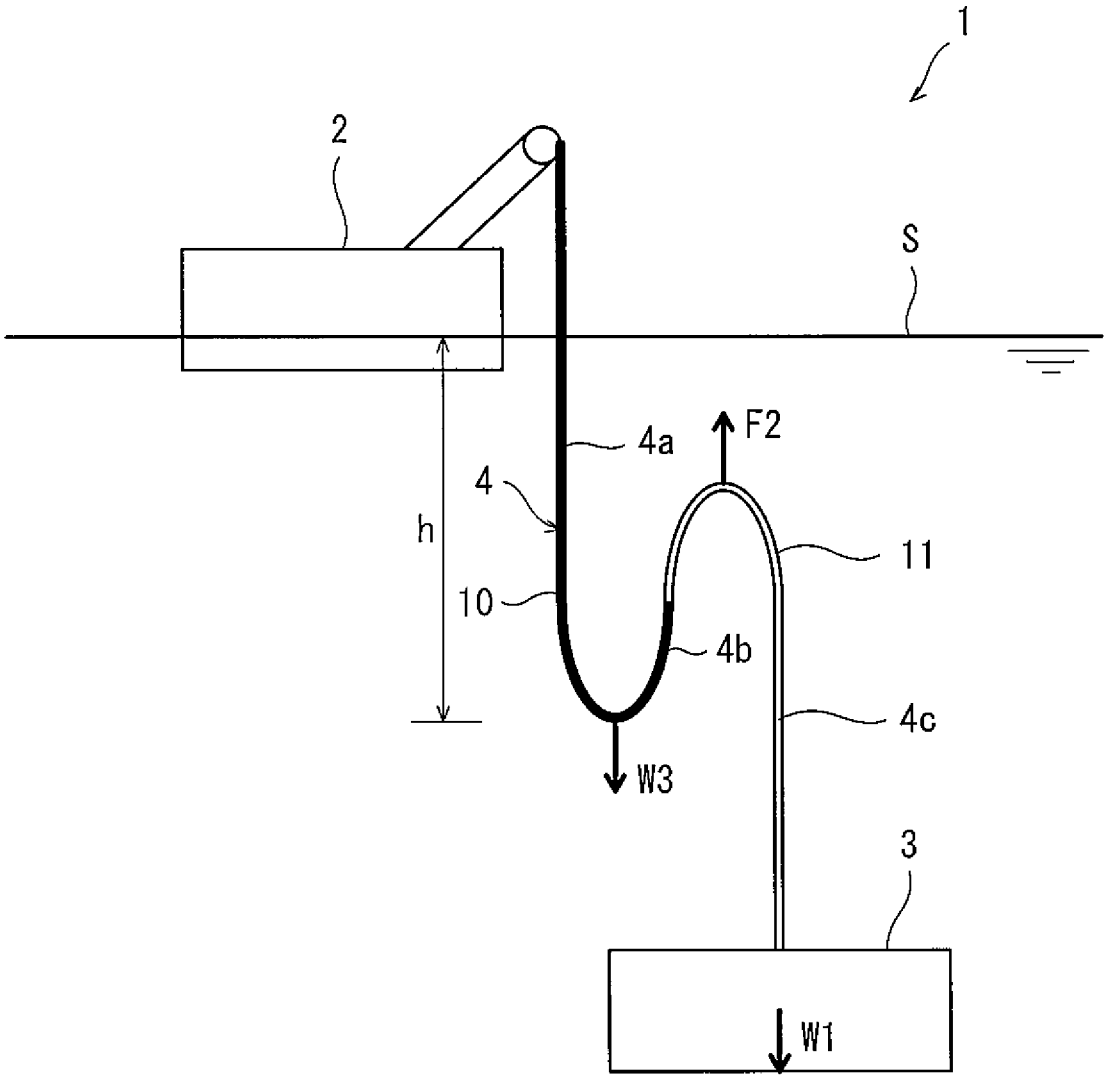
FIG. 6 is a schematic diagram schematically showing the AUV support system according to Embodiment 4.

Next, Embodiment 4 of the present invention will be described with reference to FIG. 6. FIG. 6 is a schematic diagram schematically showing the AUV support system according to Embodiment 4. As with FIGS. 2, 4, and 5, FIG. 6 shows that the surface ship 2 is in a stop state on the water.

In the present embodiment, the sinker 5 and the floating body 6 are not provided at the cable 4. Instead, the cable 4 includes: a negative buoyant force cable portion 10 that is the same in configuration as the negative buoyant force cable portion 8 described in Embodiment 2; and a positive buoyant force cable portion 11 that is the same in configuration as the positive buoyant force cable portion 9 described in Embodiment 3. The negative buoyant force cable portion 10 is a portion of the cable 4, and the gravitational force acting on this portion of the cable 4 is non-negligibly large compared to the gravitational forces and buoyant forces of the underwater station 3, the sinker 5, and the floating body 6. The positive buoyant force cable portion 11 is a portion of the cable 4, and the buoyant force acting on this portion of the cable 4 is non-negligibly large compared to the gravitational forces and buoyant forces of the underwater station 3, the sinker 5, and the floating body 6.

The negative buoyant force cable portion 10 extends from the surface ship 2, and a first end of the negative buoyant force cable portion 10 is connected to a first end of the positive buoyant force cable portion 11. Moreover, a second end of the positive buoyant force cable portion 11 is connected to the underwater station 3.

The force W3 that is a resultant force of the gravitational force and buoyant force of the negative buoyant force cable portion 10 acts on the negative buoyant force cable portion 10 in the vertically downward direction. The force W3 is represented by Formula (6) above. Moreover, the force F2 that is a resultant force of the gravitational force and buoyant force of the positive buoyant force cable portion 11 acts on the positive buoyant force cable portion 11 in the vertically upward direction. The force F2 is represented by Formula (8) above.

In the present embodiment, the gravitational force wa per unit length of the negative buoyant force cable portion 10, the buoyant force fa per unit length of the negative buoyant force cable portion 10, the gravitational force wb per unit length of the positive buoyant force cable portion 11, and the buoyant force fb per unit length of the positive buoyant force cable portion 11 are adjusted such that the force W3 and the force F2 satisfy Formula (11) below.

$$W3\geq F2-W1 \quad (11)$$

As above, as shown in FIG. 6, the negative buoyant force cable portion 10 includes: the first cable portion 4*a* extending downward from the surface ship 2 through the water surface S when the underwater station 3 is suspended in the water by the cable 4 from the surface ship 2 that is in a stop state on the water; and part of the second cable portion 4*b* extending upward from the lower end portion of the first cable portion 4*a* when the underwater station 3 is suspended as above. The positive buoyant force cable portion 11 includes: part of the second cable portion 4*b* extending upward from the lower end portion of the first cable portion 4*a* when the underwater station 3 is suspended in the water by the cable 4 from the surface ship 2 that is in a stop state on the water; and the third cable portion 4*c* extending downward from the upper end portion of the second cable portion 4*b* and connected to the underwater station 3 when the underwater station 3 is suspended as above. In other words, a connection portion where the negative buoyant force cable portion 10 and the positive buoyant force cable portion 11 are connected to each other is located at the second cable portion 4*b*.

According to the present embodiment, even when the surface ship 2 moves, the lower end portion of the first cable portion 4*a* and the lower end portion of the second cable portion 4*b* are displaced, and this can suppress the displacement magnitude of the third cable portion 4*c*. Thus, the transmission of the movement of the surface ship 2 to the underwater station 3 through the cable 4 can be suppressed.

Other Embodiments

The present invention is not limited to the above embodiments, and various modifications may be made within the scope of the present invention.

For example, the schematic diagrams of FIGS. 2 and 3 showing the support system 1 are shown in order to clearly explain a relation among the components of the support system 1, and FIGS. 2 and 3 do not limit the present invention. For example, FIGS. 2 and 3 show that the first cable portion 4*a* extends in the vertical direction. However, the first cable portion 4*a* when the surface ship 2 is in a stop state on the water may be slightly inclined relative to the vertical direction. Moreover, FIGS. 2 and 3 show that the second cable portion 4*b* is inclined relative to the vertical direction. However, the second cable portion 4*b* when the surface ship 2 is in a stop state on the water may extend in the vertical direction.

FIG. 1 does not show the AUV 7. However, the underwater station 3 with which the AUV 7 has docked may be pulled and towed by the cable 4.

In Embodiments 2 to 4, as with Embodiment 1, even when the AUV 7 has docked with the underwater station 3, the cable 4 may extend downward from the surface ship 2 toward the sinker 5, extend upward from the sinker 5 toward the floating body 6, and then extend downward from the floating body 6 toward the underwater station 3. In the respective formulas, "F" and "F2" are respectively replaced with "F+ΔF" and "F2+ΔF". Moreover, in Embodiments 2 to 4, the depth h of the lower end portion of the second cable portion 4*b* (in other words, the lower end portion of the first cable portion 4*a*) from the water surface S when the surface ship 2 is in a stop state on the water may be adjusted so as to be equal to or more than the length L of the second cable portion 4*b*.

In Embodiment 2, the negative buoyant force cable portion 8 that is a heavy portion of the cable 4 does not have to be an entire portion between the floating body 6 and the surface ship 2 in the cable 4, and may be part of this entire portion which part is immersed in the water. In Embodiment 3, the positive buoyant force cable portion 9 that is a portion of the cable 4 at which portion the buoyant force is large does not have to be an entire portion between the floating body 6 and the underwater station 3 in the cable 4, and may be part of this entire portion. In Embodiment 4, the cable 4 may include a cable portion where the gravitational force and the buoyant force are negligibly small compared to the gravitational forces and buoyant forces of the underwater station 3, the sinker 5, and the floating body 6, the cable portion being located between the first end of the negative buoyant force cable portion 10 and the first end of the positive buoyant force cable portion 11, between a second end of the negative buoyant force cable portion 10 and the surface ship 2, or between the second end of the negative buoyant force cable portion 10 and the underwater station 3.

Moreover, when the surface ship 2 is in a stop stat e on the water, one of the first cable portion 4*a* and the second cable portion 4*b* may loosen. For example, when the force F acts on the floating body 6 in the vertically upward direction and the force W1 acts on the underwater station 3 in the water in the vertically downward direction, the second cable portion 4*b* may loosen. In this case, the depth h of the sinker 5 from the water surface S when the surface ship 2 is in a stop state on the water does not have to be equal to or more than the length of a portion of the cable 4 which portion extends between the floating body 6 and the sinker 5.

Moreover, in the above embodiments, when the underwater station 3 docks with the AUV, the built in battery of the AUV can be charged in the water, and/or the data acquired by the AUV in the water can be transmitted to the surface ship 2 through the cable 4. However, the underwater station of the present invention is not limited to this. For example, the underwater station is only required to be configured to be able to dock with the AUV (i.e., the underwater station may merely play a role of making the surface ship tow the AUV which has docked with the underwater station and move the AUV to a destination).

Needless to say, the specific gravity of the water where the underwater station 3, the sinker 5, and the floating body 6 are located (for example, the specific gravity of the sea water when the support system 1 is used in the sea) is taken into consideration in the buoyant forces acting on the underwater station 3, the sinker 5, and the floating body 6 in the water. Even when the specific gravity of the water where the underwater station 3 is used changes to some extent (for example, even when the specific gravity changes between the specific gravity of pure water and the specific gravity of sea water having a high concentration of salt), the weights and volumes of of the underwater station 3, the sinker 5, and the floating body 6 may be adjusted such that Formulas (1) to (11) are satisfied.

REFERENCE SIGNS LIST

1 support system
2 surface ship
3 underwater station
4 cable
4*a* first cable portion
4*b* second cable portion
4*c* third cable portion
5 sinker
6 floating body
7 AUV (autonomous underwater vehicle)

The invention claimed is:

1. An autonomous underwater vehicle support system comprising:

a surface ship;

an autonomous underwater vehicle which autonomously sails in water;

an underwater station configured to dock with and support the autonomous underwater vehicle; and a cable connecting the surface ship and the underwater station, wherein the cable includes a first cable portion extending downward from the surface ship through a water surface when the underwater station is suspended in the water by the cable from the surface ship that is in a stop state on the water, a second cable portion extending upward from a lower end portion of the first cable portion when the underwater station is suspended as above, and a third cable portion extending downward from an upper end portion of the second cable portion and connected to the underwater station when the underwater station is suspend as above;

the autonomous underwater vehicle support system further includes a sinker located between the first cable portion and the second cable portion and a floating body located between the second cable portion and the third cable portion; and the weights and volumes of the underwater station, the sinker, the floating body, and the autonomous underwater vehicle are adjusted such that Formulas (1) to (5) below are satisfied, $$F \geq W1 \quad (1)$$

$$W2 \geq F - W1 \quad (2)$$

$$\Delta F < W1 \quad (3)$$

$$F + \Delta F \ W1 \quad (4)$$

$$W2 \geq F + \Delta F - W1 \quad (5)$$

where F denotes a value obtained by subtracting a gravitational force acting on the floating body based on the weight of the floating body from a buoyant force acting on the floating body based on the volume of the floating body in the water, W1 denotes a value obtained by subtracting a buoyant force acting on the underwater station based on the volume of the underwater station in the water from a gravitational force acting on the underwater station based on the weight of the underwater station, W2 denotes a value obtained by subtracting a buoyant force acting on the sinker based on the volume of the sinker in the water from a gravitational force acting on the sinker based on the weight of the sinker, and ΔF denotes a value obtained by subtracting a gravitational force acting on the autonomous underwater vehicle based on the weight of the autonomous underwater vehicle from a buoyant force acting on the autonomous underwater vehicle based on the volume of the autonomous underwater vehicle in the water.

2. The autonomous underwater vehicle support system according to claim 1, wherein a position of the sinker at the cable is adjusted such that a depth of the sinker from the water surface when the surface ship is in a stop state on the water is equal to or more than a length of a portion of the cable which portion extends between the floating body and the sinker.

* * * * *